United States Patent [19]

Swan

[11] Patent Number: 4,742,636

[45] Date of Patent: May 10, 1988

[54] MOUNT FOR MOUNTING AN OPTICAL SIGHT ON A FIREARM

[75] Inventor: Richard E. Swan, East Bridgewater, Mass.

[73] Assignee: Eastman Kodak Company, Rochester, N.Y.

[21] Appl. No.: 828,461

[22] Filed: Feb. 11, 1986

[51] Int. Cl.[4] ..... F41G 1/38

[52] U.S. Cl. ..... 42/101; 33/248; 33/257

[58] Field of Search ..... 42/100, 101, 103, 102; 33/247, 248, 252, 254, 257, 259, 260

[56] References Cited

U.S. PATENT DOCUMENTS

| | | | |
|---|---|---|---|
| 1,137,477 | 4/1915 | Godshalk | 33/233 |
| 2,438,601 | 3/1948 | Davis | 33/257 |
| 3,424,420 | 1/1969 | Seiderman | 42/101 |
| 3,882,609 | 5/1975 | Troutman | 42/100 |
| 3,922,794 | 12/1975 | Ackerman, Jr. | 33/248 |
| 3,942,256 | 3/1976 | Khaidurov et al. | 42/100 |
| 3,979,848 | 9/1976 | Ackerman, Jr. | 42/100 |
| 4,010,564 | 3/1977 | Pettit | 42/100 |
| 4,114,302 | 9/1978 | Litman | 42/101 |
| 4,127,943 | 12/1978 | Tiritilli | 33/260 |
| 4,192,075 | 12/1978 | Strahan | 33/257 |
| 4,539,769 | 9/1985 | Stevens et al. | 42/101 |

*Primary Examiner*—Charles T. Jordan
*Assistant Examiner*—Michael J. Carone
*Attorney, Agent, or Firm*—John B. Turner

[57] ABSTRACT

A mount for mounting an optical sight on a firearm and providing azimuth and elevation adjustments. The mount includes first and second members pivotally connected for universal movement relative to one another. One of the first and second members has pivotally connected to it a reaction member, and the other has azimuth adjustment means and elevation adjustment means. The azimuth adjustment means includes a screwthreaded portion threadedly engaged in a threaded bore in the reaction member. The elevation adjustment means includes an eccentric portion rotatable in a bore in the reaction member. The sight is bolted to the mount at one location and bolted to a carriage member, slidable on the rest of the mount, at another location whereby differential thermal expansion of the sight and mount can be accommodated.

7 Claims, 5 Drawing Sheets

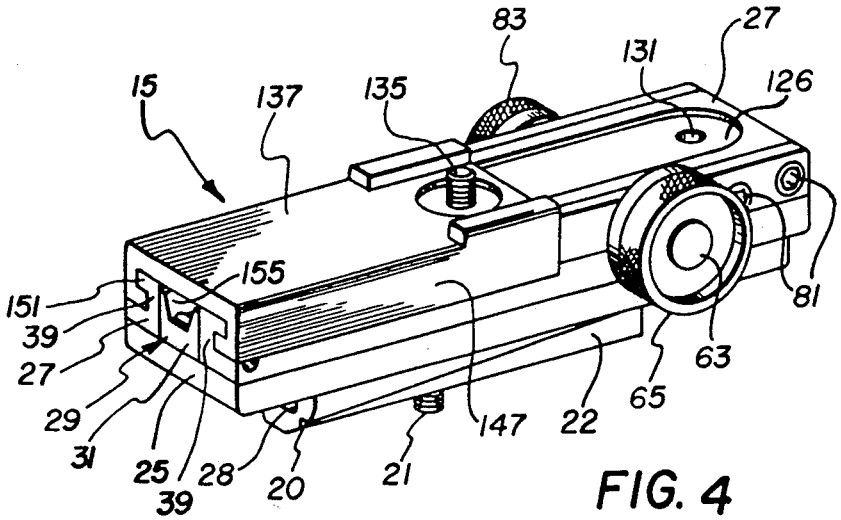
FIG. 4
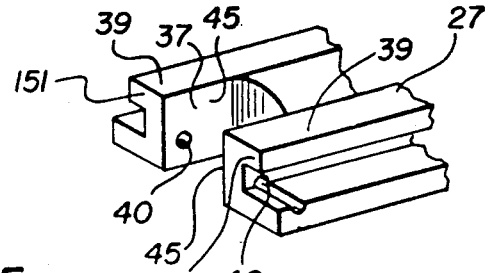
FIG. 5
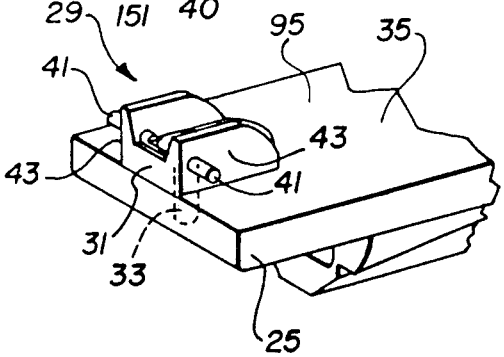

MOUNT FOR MOUNTING AN OPTICAL SIGHT ON A FIREARM

BACKGROUND OF THE INVENTION

Field of the Invention

This invention relates to mounts for mounting optical sights on firearms.

It is known that it is desirable to be able to make adjustments to an optical sight on a firearm so that with the reticle of the sight centered on the target the projectile from the firearm will hit the target in spite of the effect on the projectile of wind and/or gravity as it travels to the target. The adjustments, in effect, cause the user to aim the barrel, for example, to the left of the target, to counteract the effect of wind from the left, and above the target, to counteract the effect of gravity, when he centers the reticle on the target. These adjustments are often referred to as azimuth (or windage) and elevation.

The desired adjustments may be achieved by moving the reticle within the sight while maintaining constant the dispositional relationship of the barrel and sight as a whole. Alternatively, the sight may be moved, as a whole, relative to the barrel. The former manner of achieving the adjustment has the advantage that the mount serving to mount the sight on the firearm may be simple and rugged. It has the disadvantage that the movable reticle makes the sight more expensive to manufacture and prone to damage.

The latter manner of achieving the adjustment, namely, moving the sight as a whole, has the advantage that the sight has a fixed reticle which makes the optical sight less expensive to manufacture and less prone to damage by blows and the like in combat conditions. However, the mount is more prone to damage because it has to contain mechanisms for achieving very fine adjustments. Those skilled in the art know that the maximum range of azimuth adjustment may be as small as 10 minutes limit to limit and that the increments of adjustment may be as small as 15 seconds. Also, the elevation adjustment may have a maximum range of 1 degree and the desirable increments of adjustment may be as small as ½ minute.

Those skilled in the art know that it is highly desirable that the mount provides repeatability, that is, that the selected adjustments be exactly retained until they are intentionally changed, despite forces encountered in successive firings and despite blows and other maltreatment in combat conditions.

SUMMARY OF THE INVENTION

According to the present invention there is provided a mount for mounting an optical sight on a firearm and for providing azimuth and elevation adjustment. The mount includes a first member and a second member, one of which members is adapted for connection to the firearm and the other is adapted for connection to the sight. The first and second members are connected for universal movement relative to one another. One component of such movement is to accommodate azimuth adjustment and is about a first effective axis and an orthogonal component is to accommodate elevation adjustment and is about a second effective axis. The first member has a reaction member connected to it for pivotal movement about a third axis parallel to the second effective axis. The reaction member is constrained against movement relative to the first member in a direction parallel to the third axis. The reaction member has a first bore with its, fourth axis parallel to the third axis and a second bore with its, fifth axis parallel to the third axis. The first bore is smooth and the second bore is screw-threaded.

Azimuth adjustment means are connected to the second member by thrust bearing means which prevents movement of the azimuth adjustment means relative to the second member in a direction parallel to the fifth axis and allows rotation of the azimuth adjustment means relative to the second member. The azimuth adjustment means has a screw-threaded portion threadedly engaged in the second bore in the reaction member for reaction with the reaction member, whereby rotation of the azimuth adjustment means adjusts the inclination of the first and second members to one another about the first effective axis.

Elevation adjustment means are connected to the second member by means which prevent movement of the elevation adjustment means relative to the second member in a direction parallel to the fourth axis and allows rotation of the elevation adjustment means relative to the second member about a sixth axis. The elevation adjustment means has a portion eccentric to the sixth axis and disposed within the first bore in the reaction member for reaction with the reaction member, whereby rotation of the elevation adjustment means adjusts the inclination of the first and second members to one another about the second axis.

The reaction member may include a portion projecting from the first member into a recess in the second member. The recess is sufficiently large in a direction parallel to the fourth and fifth axes as to accommodate a full range of azimuth adjusting relative movement between the reaction member and the second member.

The reaction member, the screw-threaded portion of the azimuth adjustment means and the eccentric portion of the elevation adjustment means are preferably formed of hardened steel in order to prolong useful life. In some embodiments of the invention, other parts of the mount may be formed of other materials which have characteristics desirable for their purposes, for example, lightness of weight and resistance to corrosion, without the constraint of durability against wear.

The present invention also resides in a mount for mounting an optical sight on a firearm and for providing azimuth adjustment. The mount includes first and second members, one of which is adapted for connection to the firearm, and the other of which is adapted for connection to the sight. The first and second members are connected for pivotal movement relative to one another about a first axis to accommodate azimuth adjustment. The first member has reaction means including a screw-threaded bore. The mount has azimuth adjustment means connected to the second member by thrust bearing means which prevents movement of the azimuth adjustment means relative to the second member along the axis of the bearing means relative to the second member. The azimuth adjustment means has a screw-threaded portion threadedly engaged in the bore in the reaction means for reaction with the reaction member, whereby rotation of the azimuth adjustment means adjusts the inclination of said first and second members to one another about the first axis. In such a mount, the adjustment in both directions is positively driven by the azimuth adjustment means. This avoids the use of springs to drive in one direction, which are known to provide less repeatability than is desirable.

The present invention also resides in a mount for mounting an optical sight on a firearm and for providing elevation adjustment. The mount includes first and second members one of which is adapted for connection to the firearm and the other of which is adapted for connection to the sight. The first and second members are connected for pivotal movement relative to one another about a first axis to accommodate elevation adjustment. The first member has reaction means including a cylindrical bore having its axis parallel to said first axis. The mount includes elevation adjustment means connected to the second member by journal bearing means. The elevation adjustment means includes an eccentric portion disposed in the cylindrical bore in the reaction means for reaction with the reaction means. The eccentric portion has a barrel-shaped surface and is a fit within the cylindrical bore, whereby rotation of the elevation adjusting means causes the inclination of the first and second members to one another about the first axis to be adjusted. Because the eccentric portion is a fit within the bore in the reaction means, elevation adjustment in both directions (up and down) is positively driven. This avoids the use of springs to drive in one direction with a positive drive in the other direction. Mounts embodying springs lack a desirable level of repeatability in use.

The present invention also resides in a mount for mounting an optical sight on a firearm and providing azimuth and elevation adjustment. The mount includes a first member adapted to be connected to a firearm, and a second member. There are first means for fixedly securing the second member to the sight at a first location. Pivot means pivotally connect the first member to the second member. Azimuth adjustment means adjust the relationship of the first and second members to one another in first, azimuth directions. Elevation adjustment means adjust the relationship of the first and second members in second, elevation directions orthogonal to said first, azimuth directions. The second member has track means extensive in a direction generally orthogonal to both said first and second directions. There are means slidable on the track means and adapted to be secured to the sight at a second location spaced from the first location along a line generally parallel to the direction in which said track means is extensive. Such a mount avoids the problems of differential thermal expansion of the sight and the mount which would occur if the sight were bolted directly to the mount at two spaced locations.

Preferably, the track means includes a V-shaped track and rails. The means slidable on the track preferably includes a carriage member, a frusto-conical projection at one side of the carriage member for engaging the V-shaped track, and resilient biasing means acting between the projection and the carriage member. The track means has rails and the carriage member has surfaces for cooperation with the rails. The surfaces and rails are adapted to oppose the bias of the resilient biasing means.

BRIEF DESCRIPTION OF THE DRAWINGS

Embodiments of the present invention will now be described by way of example, with reference to the accompanying drawings, in which:

FIG. 4 is a perspective view of the mount in FIG. 1, without the firearm or the sight;

FIG. 5 is a diagrammatic representation of portions of some of the components of the mount illustrated in FIG. 4;

DETAILED DESCRIPTION OF THE PREFERRED EMBODIMENT

Figure 1:
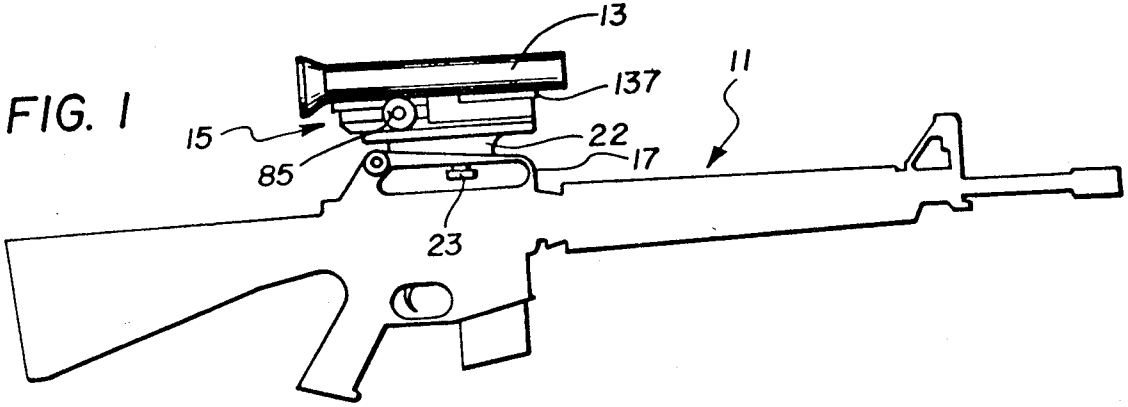
FIG. 1 is a diagrammatic representation of a firearm and a telescopic sight with a mount in accordance with the present invention, mounting the sight on the rifle.
Figure 3:
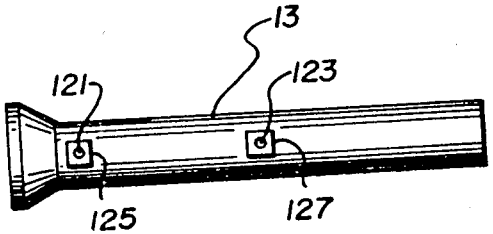
FIG. 3 is an underside view of the sight illustrated in FIG. 1.
Figure 2:
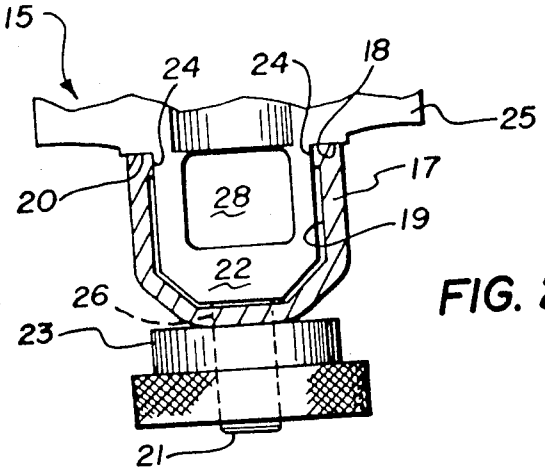
FIG. 2 is a scrap view, partially in section, showing the interconnection of the mount with the firearm.

FIG. 1 illustrates a rifle 11 and a telescopic sight 13, the latter being mounted on the rifle through the intermediary of a mount 15 embodying the present invention. The rifle 11 includes a handle 17. The upper surface of the handle has a channel 19, as may be seen in FIG. 2. The channel is bounded by flat shoulders 18 which extend the length of the handle. The underside of the mount 15 has shoulders 20 for seating on the shoulders 18. The underside of the mount includes a rib 22 which projects into the channel. The rib 22 has side surfaces 24 which fit in the channel in order to prevent lateral movement of the mount 15 relative to the rifle 11.

The mount includes a downwardly projecting threaded stud 21 which extends through a bore in the handle 17. A nut 23 engaged on the stud 21 secures the mount to the rifle. The cooperation of the shoulders 18 and 20 and of the side surfaces 24 of the rib 22 with the bounding wall of the channel 19, and the stud 21 and nut 23 serve to secure the mount to the rifle in a manner such that there can be no relative movement between the mount, as a whole, and the rifle.

The rib 22 of the mount has a passage 28 extending throughout its length so that the iron sights of the rifle may still be used when the mount 15 and sight 13 are on the rifle.

The manner of securing the sight 13 to the mount 15 will be described later, after further description of the mount.

Reference is now made to FIGS. 4 to 10. The mount 15 includes a first member 25 and a second member 27. The first member 25 is the lower and it is its underside which contacts the handle 17 of the rifle. The first and second members 25 and 27 are connected by pivot means 29 which provide for universal movement of the members 25 and 27 relative to one another. The pivot means 29 includes an intermediary member 31 which is pivotally connected to the first member 25 by a pivot pin 33. The axis of the pivot pin 33 is perpendicular to the upper surface 35 of the first member 25. The pivot pin 33 is in the form of a bolt which is threadedly engaged in the first member and thereby prevents the pin and the intermediary member 31 from moving relative to the first member in a direction axially of the pin 33. If the first member 25 is formed of a material in which screw threads might be non-durable, an insert, of, for example, hardened steel, may be provided in the first member to threadedly engage the bolt.

The intermediary member 31 has a planar lower surface which slides over the upper surface 35 of the first member 25 when there is relative pivoting movement between the intermediary member 31 and the first member 25. The second member 27 has an opening 37 for receiving the intermediary member 31. To each side of the opening 37 are portions 39 of the second member 27 which constitute trunnions and have bores 40 to receive a pivot pin 41 which extends through the intermediary member 31. The second member 27 is able to pivot about the pivot pin 41 but is prevented from lateral movement relative to the intermediary member 31 (i.e., movement in the direction parallel to the axis of the pivot pin 41) by engagement of the side faces 43 of the intermediary member with the inwardly facing surfaces 45 of the trunnion portions 39 of the second member 27. The pivot pin 41 is a close fit in the bores 40 and in the intermediary member. The pivot pin 33 is substantially vertical when the rifle is held in a firing position with the barrel horizontal and the pivot pin 41 is substantially horizontal in such circumstance. The pivot pin 41 is substantially perpendicular to a line parallel to the axis of the barrel.

It will be realized that because the intermediary member 31 and the second member 27 can pivot relative to the first member 25 about the pivot pin 33 and because the second member 27 can pivot relative to the intermediary member 31 and the first member 25 about the pivot pin 41 there is provision for universal relative pivoting movement between the first and second members 25 and 27.

The first member 25 includes a recess 47 (see FIG. 7) in which is disposed a reaction member 49. The reaction member 49 is carried by a pivot pin 51 which extends through the first member 25 and the reaction member 49 so that it can rock relative to the first member 25, about the pivot pin 51. The reaction member 49 and the recess 47 are so sized that the reaction member has no freedom to move, relative to the first member, in a direction parallel to the axis of the pivot pin 51.

In a portion of the reaction member 49 extending above the first member there are first and second bores 53 and 55 the axes of which are parallel to one another and to the axis of the pivot pin 51. The first bore 53 is disposed substantially over the pivot pin 51 and is smooth. The second bore 55 is disposed between the bore 53 and the pivot means 29 and is screw-threaded.

Figure 6:
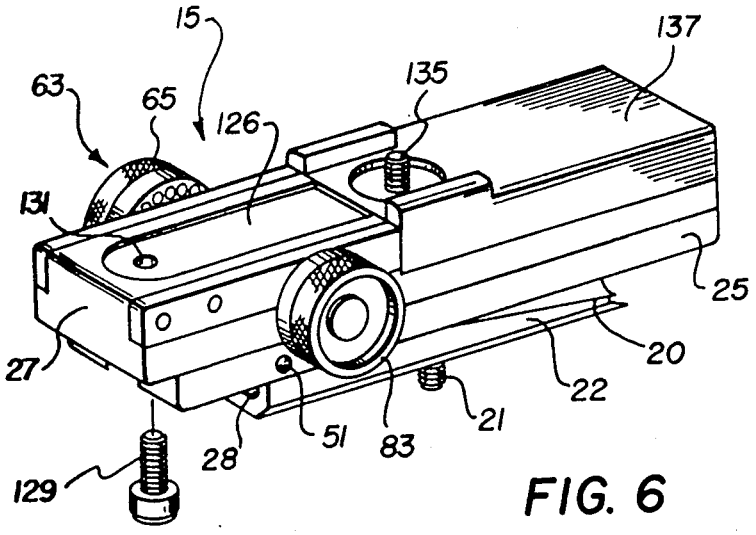
FIG. 6 is a perspective view of the mount of FIG. 1, from a viewpoint different to that in FIG. 4.

The second member 27 has a recess 57 (see FIG. 7) which receives the reaction member 49 with clearance. The second member 27 has a transverse bore 59 which extends from the left side (as considered when the mount is on the rifle and as seen in FIG. 6) of the second member 27 and intersects the recess 57. The axis of the bore 59 is so disposed that it passes through a possible position of the bore 53 in the reaction member 49 when the angle between the first and second members 25 and 27 is only small. The second member 27 has a further transverse bore 61 which extends from the other (the right) side of the second member 27 and also intersects the recess. The bore 61 is so disposed that a line can extend through it and the bore 55 in the reaction member 49 when there is only a small inclination between the first and second members 25 and 27.

Figure 8:
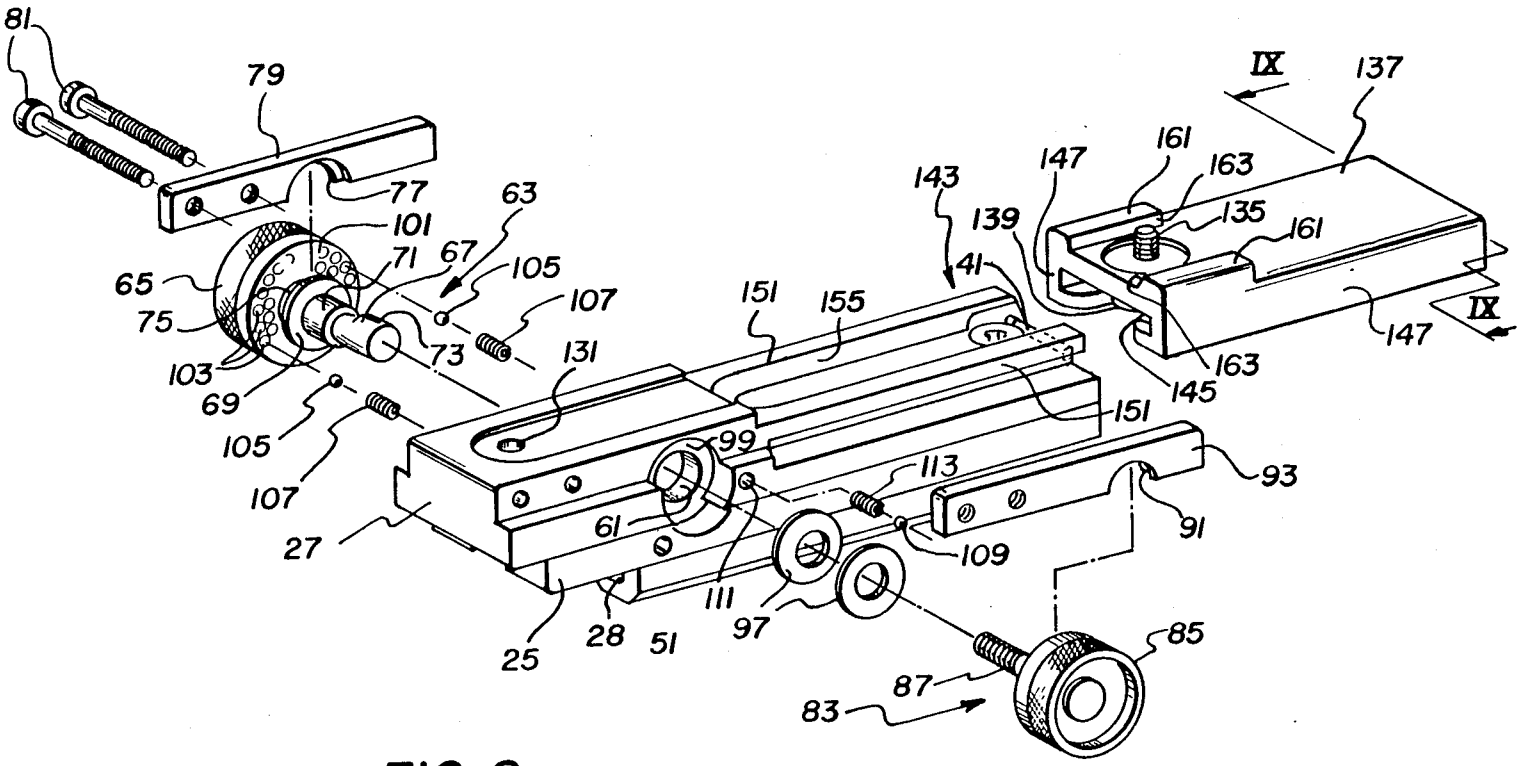
FIG. 8 is a view of the mount from a viewpoint similar to that in FIG. 6, but partially exploded.
Figure 9:
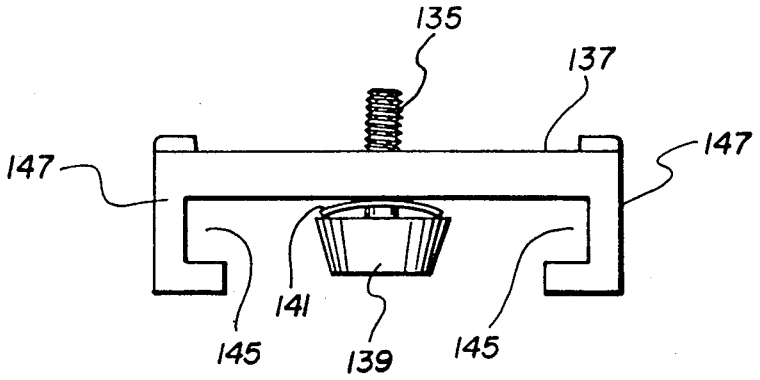
FIG. 9 is an end view of a component of the mount, taken generally on the line IX—IX in FIG. 8.
Figure 10:
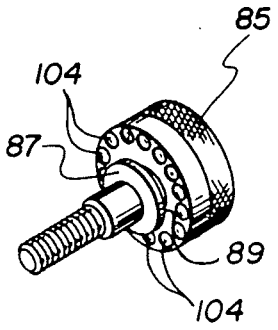
FIG. 10 is a perspective view of a component, an adjustment knob, included in the mount.

With references now to FIG. 8, an elevation adjustment member 63 includes a knob 65 unitary with a shaft 67. The shaft 67 includes a large diameter portion 69, an intermediate diameter portion 71 and an eccentric portion 73 with a barrel-shape surface. The maximum diameter of the barrel-shape eccentric portion 73 is such that it is axially slidable into and is rotatable with a fit in, the smooth bore 53 in the reaction member 49 i.e. the eccentric portion is a close fit within the bore 53. The large diameter portion 69 has a circumferential undercut 75 for cooperation with a semi-annular rib 77 on a keeper 79. The keeper 79 is secured to the second member 27 by two bolts 81. With the elevation adjustment member 63 in operative position, the eccentric portion 73 is disposed in the bore 53 in the reaction member 49 and the rib 77 on the keeper 79 seats in the undercut 75 and prevents axially directed movement of the adjustment member 63 relative to the second member 27. The intermediate diameter portion 71 of the shaft 67 is a fit in the bore 59 in the second member 27 so that the shaft 67 is constrained against movement perpendicular to the shaft 67. Thus, the bore 59 forms a journal bearing.

An azimuth adjustment member 83 includes a knob 85 and a screw-threaded shaft 87. The shaft 87 extends through the bore 61 in the second member into the bore 55 in the reaction member 49 in which it is screw-threadedly engaged. The azimuth-knob 85 has a portion 88 with a circumferential undercut 89 for cooperation with a rib 91 of a keeper 93. The cooperation of the rib 91 and undercut 89 prevents the azimuth adjustment member 83 moving axially relative to the second member 27 and, in this sense, the keeper and its rib constitute thrust bearing means; however, it does allow the adjustment member 83 limited freedom for movement in a direction perpendicular to the axis of the shaft 87 and parallel to the general plane of the under surface 95 (see FIG. 7) of the second member 27. The bore 61 is so dimensioned and shaped as to cooperate in this limited freedom of movement. A pair of belleville washers 97 are disposed on the shaft 87 and act between a surface 99 of the second member 27 and the portion 87 of the knob 85. The washers 97 serve to take out of the azimuth adjustment system any slop that might otherwise exist.

The keeper 93 is secured to the second member 27 by the bolts 81 which extend through the second member 27.

Both the azimuth adjustment system and the elevation adjustment system have detent means. A surface 101 of the elevation adjustment knob 65 facing the second member has two concentric circular rows of depressions 103, the depressions in the rows being offset. The depressions 103 cooperate with balls 105 projecting from bores (not shown) in the second member 27. Behind the balls, in the bores, are springs 107 biasing the balls towards the knob 65. The knob 85 has a single circular row of depressions 104 for cooperation with a ball 109 projecting from a bore 111 in the second member 27. A spring 113 in the bore 111 biases the bail towards the knob 85.

The sight 13 is secured to the mount 15 in a manner which avoids problems which might otherwise occur due to differential thermal expansion of the sight and the mount. As is known, some military specifications require that equipment operate satisfactorily throughout the range of $-80°$ to $+180°$ F. Such a large range has the potential for problems to occur due to differential thermal expansion.

The sight has two threaded bores 121 and 123 each of which is open in a respective one of two coplanar lands 125, 127. A bolt 129 extends through bore 131 in the second member 27 into the threaded bore 121 in the sight (see FIG. 6). The second member 27 has a planar land 126 for cooperation with the land 125 on the sight. The head of the bolt 129 is accessible through a cutout 133 in the first member for tightening the bolt 129.

A bolt 135 extends upwards from a carriage member 137 and is threadedly engaged in bore 123. The bolt 135 extends through an aperture in the carriage member and has a frusto-conical head 139 (see FIG. 9). A belleville washer 141 is disposed between the head 139 and the carriage member 137. The carriage member 137 is attached to the second member 27 by a track system 143 which allows sliding movement of the carriage member and the second member relative to one another in a direction generally parallel to the axis of the sight 13 and barrel of the rifle 11. The track system 143 includes longitudinally extensive undercuts 145 in downwardly projecting flanges 147 at the underside of the carriage member 137. The second member 27 has laterally projecting longitudinally extensive rails 151 which are so dimensioned as to be sliding fits in the undercuts 145. Thus, the rails 151 by engagement with the walls of the undercuts 145 allow sliding movement of the carriage member 137 relative to the second member 27 in directions parallel to the length of the rails (i.e. parallel to the axis of the sight and the rifle barrel) so that if the sight should thermally expand or contract differentially to the second member 27, the difference in expansion can be accommodated by sliding of the carriage member 137.

The orientation of the axis of the sight 13 to the second member is not dependent on the undercuts 145 and rails 151. A V-shaped track 155 is formed in the second member 27 and, so that it is continued to an end of the second member, also in the intermediary member 31. The angle of the sides of the V-shaped track to one another is the same as the cone angle of the frusto-conical head 139 of the bolt 135. The longitudinal axis of the track 155 is parallel to the lengths of the rails 151. When the carriage member 137 is in operative position on the second member 27, the frusto-conical head 139 bears against the V-shaped track 155. The belleville washer 141 reacts against the head 139 and biases the head into engagement with the track. Thus, the cooperation of the V-shaped track 155 and the frusto-conical head 139 of the bolt 135, together with the cooperation of the rails 151 and the undercuts 145, positively locates the axis of the sight.

The carriage member 137 has upstanding ribs 161 with facing shoulders 163 which engage shoulders at the sides of the land 127 on the sight 13.

The elevation adjustment member 63, the azimuth adjustment member 83, the reaction member 49, and the pivot pin 51 are formed of hardened steel so that even in the presence of intrusive abrasive particles wear is minimized. In the present embodiment, the first and second members 25 and 27 are formed of aluminum alloy for weight economy. They could, in other embodiments, be formed of composite materials such as fiber reinforced resin.

Assuming that the sight 13 is separate from the mount and the mount is separate from the rifle, the three items are assembled as follows. The carriage member 137 is detached from the remainder of the mount 15 and is brought up to the sight so that the bore 123 is aligned with the bolt 135. The bolt is threadedly engaged in the bore. The carriage member 137, with the sight now attached, is slid onto the remainder of the mount with the rails 151 initially entering and subsequently sliding along the undercuts 145. The head 139 of the bolt 135 enters the V-shaped track 155 and slides along it. The carriage member 137 is slid onto the remainder of the mount until the bore 121 in the sight is aligned with the bore 131 in the second member 27. The bolt 129 is then inserted through the bore 130 and threadedly engaged in the threaded bore 121. The sight 13 has now been installed on and secured to the mount.

The mount 15 is brought up to the handle 17 of the rifle 11 so that the rib 22 enters the channel 19 with the stud 21 extending through the bore 26 in the handle. The nut 23 is threadedly engaged on the stud 21 and tightened down. The mount and sight have now been secured to the rifle 11 and there is no freedom for unwanted displacement of the sight 13 relative to the rifle 11 in any direction.

In order to adjust the azimuth of the sight, that is, in order to adjust the relationship of the axis of the sight to the axis of the barrel of the rifle when viewed in plan (assuming the axis of the rifle barrel is generally horizontal), the knob 85 is grasped and rotated in an appropriate direction. Because the shaft 87 is screw-threadedly engaged in the bore 55 in the reaction member 49 and because the reaction member 49 cannot move relative to the first member 25 in a direction parallel to the axis of the shaft 87, and because the knob 85 cannot move relative to the second member 27 in a direction parallel to the axis of the shaft 87 by virtue of the keeper 93, rotation of the knob 85 causes displacement of the second member 27 relative to the first member 25 angularly about the pivot pin 33. The ball 109 biased by spring 113 into one of the depressions 104 in the knob 85 serves to hold the knob in the desired position and also to present manually detectable increments of rotation of the knob as the ball rises out of one detent and drops into the next. Obviously, azimuth adjustments in both directions can be effected by clockwise or counterclockwise rotation of the knob 85. Because the axis of the shaft 67 of the elevation adjustment member 63 has no freedom to change its disposition relative to the second member 27, there is a change in the inclination of the axis of the elevation adjustment member shaft 67 to the axis of the bore 53 in the reaction member 49 as the second member 27 moves relative to the first member 25 during an azimuth adjustment. This change in inclination is accommodated by the barrel shape of the surface of the eccentric portion 73 of the elevation adjustment member 63. The barrel shape allows the inclination of the axes to change but maintains a circumferentially complete line contact of the eccentric portion 73 with the surface of the bore 53.

The azimuth adjustment is held in its desired setting by the spring biased engagement of the ball 109 in a depression 104 in the knob 85.

Figure 7:
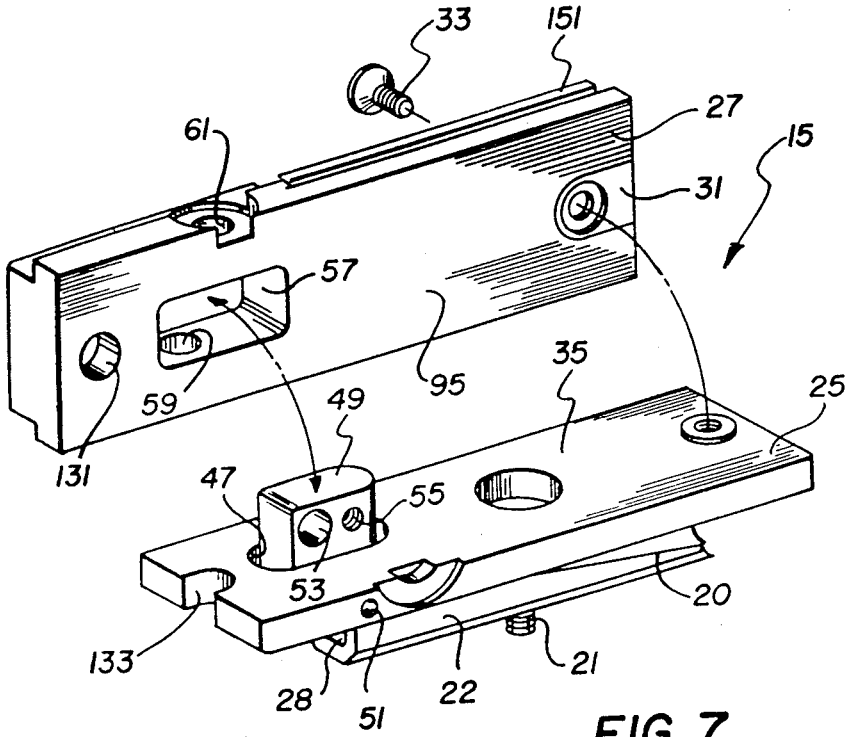
FIG. 7 is an exploded view of some of the components of the mount illustrated in FIGS. 4 to 6.

In order to adjust elevation, the elevation adjustment member 63 is manually grasped and turned. Turning of the knob 65 causes rotation of the eccentric portion 73 in the bore 53 of the reaction member 49. Rotation of the eccentric portion 73 in the bore 53 causes displacement of the axis of the shaft 67 relative to the axis of the bore 53. This displacement can be regarded as having two components, one being substantially perpendicular to the plane of the upper surface of the first member 25, as seen in FIG. 7, and the other being parallel to that surface. The perpendicular component of the displacement is accommodated by movement of the second member 27 relative to the first member 25 about the pivot pin 41. This gives the desired elevation adjustment. The nature of the accommodation of the other component of the displacement is more complex and includes the following factors: the ability of the reaction member 49 to rock about its pivot 51; the engagement of the azimuth adjustment member 83 in the bore 55 in the reaction member; and the limited freedom of the azimuth adjustment member 83 to move relative to the second member in a direction generally parallel to the undersurface of the second member 27 but the inability to move relative to the second member in a direction perpendicular to the undersurface.

The elevation adjustment knob 65 is held in a desired setting by one of the balls 105 being biased into one of the depressions 103. As in the case of the azimuth adjustment so also is the case of elevation adjustment, the detents also give manually detectable increments of rotation. In order that each increment may represent the same change in elevation, the spacings of the detents are non-uniform to accommodate the fact that by virtue of the eccentric, each unit of rotation of the knob does not give the same increment of elevation.

It has been stated above that the azimuth adjustment member 83 moves relative to the second member 27 in a direction transverse to its axis and parallel to the general plane of the second member 27 when an elevation adjustment is made. In some embodiments it may be found that such movement is sufficient to cause the ball 109 to ride out of its depression 104. If this occurred, the effect of the detent means would be lost. To avoid such a condition the depressions 104 may be given an elongate form with the elongation being radial to the axis of the shaft 87. The circumferential dimension of the depressions would still be such that the ball would be a tight fit in that direction. The ball would, as is shown, be located on a line passing through the axis of the shaft 87 and generally parallel to the general plane of the second member 27.

If so desired, a portion of the upper (as seen in FIG. 7) surface of the reaction member 49 and a portion of the opposing surface of the recess 57 in the second member 27, may both be so formed as to remain in contact with one another throughout the range of elevation adjustment. This arrangement has an advantage in making the mount more resistant to damage caused by blows.

Also, if desired, springs may act between the first member 25 and the second member 27 in the direction tending to increase the angle between them, considered about the pivot pin 41. Such springs, if included, would remove any slop existing initially in the elevation adjustment or arising subsequently due to wear.

What is claimed is:

1. A mount for mounting an optical sight on a firearm and for providing elevation adjustment, including;

a first member;

a second member;

one of said first and second members being adapted for connection to the firearm and the other being adapted for connection to the sight;

said first and second members being connected for pivotal movement relative to one another about a first axis to accommodate elevation adjustment;

said first member having reaction means including a cylindrical bore having its axis parallel to said first axis;

elevation adjustment means;

journal bearing means connecting said elevation adjustment means to said second member, said elevation adjustment means including an eccentric portion disposed in said cylindrical bore in said reaction means for reaction with said reaction means; and said eccentric portion having a barrel-shaped surface and being a close fit within said cylindrical bore, whereby rotation of said elevation adjusting means causes the inclination of said first and second members to one another about said first axis to be adjusted.

2. A mount for mounting an optical sight on a firearm and providing azimuth and elevation adjustment, including:

a first member adapted to be connected to the firearm;

a second member;

first means for fixedly securing the second member to said sight at a first location;

pivot means for pivotally connecting said first member to said second member;

azimuth adjustment means for adjusting the relationship of said first and second members to one another in first, azimuth directions;

elevation adjustment means for adjusting the relationship of said first and second members to one another in a second, elevation directions orthogonal to said first azimuth directions;

track means on said second member extensive in a direction generally orthogonal to both said first and second directions and including a V-shaped track and rails; and means slidable on said track means and adapted to be secured to said sight at a second location spaced from said first location along a line generally parallel to the direction in which said track means is extensive, said means slidable on said track including a carriage member, a frusto-conical projection at one side of the carriage member for engaging the V-shaped track, and resilient biasing means acting between said projection and said carriage member; and said carriage member having surfaces for cooperation with said rails, said surfaces and said rails being adapted to oppose the bias of said resilient biasing means.

3. A mount for mounting an optical sight on a firearm and for providing azimuth and elevation adjustment including;

a first member;

a second member;

one of said first and second members being adapted for connection to the firearm and the other being adapted for connection to the sight;

said first and second members being connected for universal movement relative to one another; one component of said movement being to accommodate azimuth adjustment and being about a first effective axis, and an orthogonal component of said movement being to accommodate elevation adjustment and being about a second effective axis, said first member having a reaction member connected thereto for pivotal movement about a third axis parallel to said second effective axis, said reaction member being constrained against movement relative to said first member in a direction parallel to said third axis;

said reaction member having a first bore having a fourth axis, said fourth axis being parallel to said third axis, and a second bore having a fifth axis, said fifth axis being parallel to said third axis, said first bore being smooth and said second bore being screw-threaded;

azimuth adjustment means;

thrust bearing means connecting said azimuth adjustment means to said second member, said thrust bearing means preventing movement of the azimuth adjustment means relative to the second member in a direction parallel to said fifth axis and allowing rotation of the azimuth adjustment means relative to the second member, said azimuth adjustment means having a screw-threaded portion threadedly engaged in the second bore in said reaction member for reaction with said reaction member whereby rotation of said azimuth adjustment means adjusts the inclination of said first and second members to one another about said first effective axis;

elevation adjustment means; and means connecting said elevation adjustment means to said second member, said connecting means preventing movement of the elevation adjustment means relative to the second member in a direction parallel to said fourth axis and allowing rotation of the elevation adjustment means relative to said second member about a sixth axis, said elevation adjustment means having a portion eccentric to said sixth axis and disposed within said first bore in said reaction member for reaction with said reaction member whereby rotation of said elevation adjustment means adjusts the inclination of the said first and second members to one another about said second axis.

4. A mount as claimed in claim 3, wherein said reaction member includes a portion projecting from said first member; and said second member has a recess adapted to accommodate said projecting portion of said reaction member, said recess being sufficiently large in a direction parallel to said fourth and fifth axes, as to accommodate a full range of azimuth adjusting relative movement between the reaction member and the second member.

5. A mount as claimed in claim 3, wherein said reaction member, said screw-threaded portion of said azimuth adjustment means and said eccentric portion of said elevation adjustment means are formed of hardened steel.

6. A mount as claimed in claim 3, wherein said means connecting said elevation adjustment means to said second member prevents movement of the said elevation adjustment means also in directions orthogonal to said direction parallel to said fourth axis and to one another, said eccentric portion having a barrel-shaped surface having a maximum diameter substantially equal to that of said first bore in said reaction member, whereby said eccentric portion retains circumferential contact with the bounding surface of said first bore upon variation in the angular relationship of the fourth axis and the sixth axis.

7. A mount as claimed in claim 3, wherein said thrust bearing means connecting said azimuth adjustment means and said second member allows movement of the azimuth adjustment means relative to the second member in a direction generally parallel to a plane containing said fifth axis and said sixth axis and prevents movement of the azimuth adjustment means relative to the second member in a direction perpendicular to said plane.

* * * * *